US008950084B2

(12) United States Patent
Park et al.

(10) Patent No.: US 8,950,084 B2
(45) Date of Patent: Feb. 10, 2015

(54) SEMI-DRY METHOD OF WASHING MACHINE AND THE VENTILATING STRUCTURE, CONTROL APPARATUS FOR THE SAME

(75) Inventors: Seok Kyu Park, Changwon-si (KR); Ki Ho Kang, Changwon-si (KR); Yong Kyu Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 250 days.

(21) Appl. No.: 12/775,806

(22) Filed: May 7, 2010

(65) Prior Publication Data

US 2010/0275657 A1 Nov. 4, 2010

Related U.S. Application Data

(62) Division of application No. 10/565,757, filed on Oct. 5, 2006, now Pat. No. 7,721,462.

(30) Foreign Application Priority Data

| | | |
|---|---|---|
| Jul. 25, 2003 | (KR) | 10-2003-0051423 |
| Oct. 7, 2003 | (KR) | 10-2003-0069612 |
| Oct. 31, 2003 | (KR) | 10-2003-0077026 |
| Nov. 29, 2003 | (KR) | 10-2003-0085990 |
| Nov. 29, 2003 | (KR) | 10-2003-0085992 |
| Jul. 23, 2004 | (WO) | PCT/KR2004/001847 |

(51) Int. Cl.

| | |
|---|---|
| ***D06F 58/10*** | (2006.01) |
| ***D06F 29/00*** | (2006.01) |
| ***D06F 35/00*** | (2006.01) |

(52) U.S. Cl.

CPC ..... *D06F 35/007* (2013.01)
USPC ..... 34/603; 34/82; 34/235; 68/20; 68/19.2

(58) Field of Classification Search

CPC ..... D06F 35/007; D06F 37/28; D06F 39/14; D06F 58/20; D06F 58/22
USPC ..... 34/108, 233, 603, 605, 82, 235; 68/20, 68/19.2, 34, 196
See application file for complete search history.

(56) References Cited

U.S. PATENT DOCUMENTS 4,787,121 A * 11/1988 Racenis et al. ..... 16/356
4,843,671 A 7/1989 Hirooka et al.

(Continued)

FOREIGN PATENT DOCUMENTS

GB 2285270 A * 7/1995 ..... D06F 39/08
JP 05-031292 2/1993

(Continued)

OTHER PUBLICATIONS

Abstract for Muto et al., JP2000-350891 A, Dec. 2000.*

(Continued)

*Primary Examiner* — Jiping Lu
(74) *Attorney, Agent, or Firm* — KED & Associates LLP

(57) ABSTRACT

A semi-drying method of a washing machine, and a ventilating structure and a control apparatus for the same. In the semi-drying method, the dehydration and disentanglement of cloth are repeated plural times, and a washing tub is rotated at a designated dehydration speed for a time longer than that of the conventional dehydrating operation so as to minimize the jamming of the cloth into water pores of the washing tub, thereby increasing the dehydration degree of the cloth compared to the conventional dehydrating operation, removing offensive odors from the cloth, preventing damage to the cloth, allowing a user to select the duration of a semi-drying operation and to see the state of the semi-drying operation, and ventilating the washing tub during the semi-drying operation to improve the dehydration degree of the cloth.

22 Claims, 13 Drawing Sheets

(56) References Cited

U.S. PATENT DOCUMENTS

| | | | | |
|---|---|---|---|---|
| 5,092,140 | A | 3/1992 | Matsuo et al. | |
| 5,165,260 | A | 11/1992 | Geiger et al. | |
| 5,570,596 | A | 11/1996 | Imai et al. | |
| 5,870,905 | A | 2/1999 | Imamura et al. | |
| 6,401,284 | B1 | 6/2002 | Jeon et al. | |
| 6,553,596 | B2 | 4/2003 | Kim et al. | |
| 6,688,967 | B2 * | 2/2004 | Mafi et al. | 454/276 |
| 2004/0221474 | A1 | 11/2004 | Slutsky et al. | |

FOREIGN PATENT DOCUMENTS

| | | | | |
|---|---|---|---|---|
| JP | 2000-350891 A | * | 12/2000 | D06F 37/28 |
| KR | 10-0161900 | | 8/1998 | |
| KR | 10-0179107 | | 11/1998 | |
| KR | 10-2003-0065271 | | 8/2003 | |
| KR | 2003-0065271 | * | 8/2003 | D06F 25/00 |

OTHER PUBLICATIONS

Translation for Muto et al., JP2000-350891 A, Dec. 2000.*
International Search Report dated Oct. 20, 2004.
Korean Office Action dated Apr. 28, 2006.
Korean Office Action dated May 9, 2006.
Japanese Office Action dated Jul. 29, 2008.
Chinese Office Action dated Oct. 25, 2008.
U.S. Office Action for U.S. Appl. No. 10/565,757 dated Jul. 20, 2009.

* cited by examiner

SEMI-DRY METHOD OF WASHING MACHINE AND THE VENTILATING STRUCTURE, CONTROL APPARATUS FOR THE SAME

This application is a Divisional of prior U.S. application Ser. No. 10/565,757 filed Oct. 5, 2006 now U.S. Pat. No. 7,721,462, which claims priority to PCT/KR2004/001847 filed Jul. 23, 2004, the disclosures of which are hereby incorporated by reference.

TECHNICAL FIELD

The present invention relates to a washing machine, and more particularly to a semi-drying method of a washing machine, in which the dehydration and disentanglement of cloth are repeated plural times so that the cloth is dehydrated to a designated degree, and a ventilating structure and a control apparatus for the same.

BACKGROUND ART

FIG. 1 is a longitudinal-sectional view of a conventional fully automatic washing machine.

The fully automatic washing machine shown in FIG. 1 comprises a cabinet 2 provided with a door 1 installed on the upper surface thereof, an outer tub 4 supported by a damper 3 inside the cabinet 2, an inner tub 6 rotatably installed inside the outer tub 4 and provided with a plurality of water pores 6*a*, an actuating unit 8 installed below the outer tub 4 for rotating the inner tub 6, a water supply device 10 for supplying wash water to the outer tub 4 and the inner tub 6, and a drain device 12 for discharging the wash water, supplied to the outer tub 4 and the inner tub 6, to the outside.

Further, a detergent box 14 for storing detergent to be supplied together with the wash water in a washing operation, and a control apparatus 16 for controlling the overall operation of the washing machine are installed in the cabinet 2. Further, a heater (not shown) for heating the wash water supplied to the outer tub 4 and the inner tub 2 is installed in the outer tub 4.

Generally, a washing method of the above-described washing machine sequentially comprises a washing operation for removing dirt from cloth, a rinsing operation for rinsing the cloth with clean wash water, a dehydrating operation for removing moisture from the cloth, and the above operations can be selectively performed according to user's selection.

Hereinafter, the washing method of the washing machine sequentially comprising the washing, rinsing and dehydrating operations will be described.

First, when cloth is put into the inner tub 6 and the washing machine is operated, wash water and detergent are supplied to the outer tub 4 and the inner tub 6, and the inner tub 6 is rotated by the actuating unit 8. Then, the cloth is washed by the chemical action of the detergent, the current of the wash water, and the friction between the cloth and the inner tub 6. Then, the contaminated wash water is discharged to the outside through the drain device 12. Thereby, the washing operation is terminated.

Thereafter, the wash water is supplied again to the outer tub 4 and the inner tub 6, and rinses the cloth placed in the inner tub 6 by the rotation of the inner tub 6, and the contaminated wash water is discharged to the outside through the drain device 12. The above rinsing operation is repeated plural times.

After the rinsing operation is repeated plural times, the inner tub 6 is rotated at a high speed of 1,000-3,000 rpm for 3 minutes to 5 minutes to dehydrate the cloth by means of centrifugal force. The water obtained by the dehydration of the cloth is discharged to the outside through the drain device 12. Thereby, the dehydrating operation is terminated.

After a process from the washing operation to the dehydrating operation is terminated, the cloth, which is still wet, is taken out of the inner tub 6 and naturally dried.

FIG. 2 is a longitudinal-sectional view of a conventional drum washing machine having a drying device 30 for completely drying cloth. Other components of the washing machine of FIG. 2 except for the drying device 30 are similar to those of the fully automatic washing machine of FIG. 1, and thus a detailed description of the components will be omitted and only the drying device 30 will be described below.

As shown in FIG. 2, the drying device 30 includes a drying duct 32 connected to an outer tub 40 for guiding the circulation of air into an inner tub 42, a drying heater 34 for heating the air circulated through the drying duct 32 to generate hot wind, and a drying fan 36 for forcibly supplying the hot wind of the drying duct 32 to the inside of the outer tub 40.

After the dehydrating operation is terminated, the drum washing machine having the above drying device 30 performs a drying operation, in which the cloth in the inner tub 42 is dried using the drying device 30 in a short period of time.

In the washing methods of the above-described conventional washing machines, since the inner tub 6 or 42 is rotated from the beginning at a predetermined high hydration speed in the dehydrating operation so as to remove a large quantity of moisture from the cloth in a short period of time, the cloth is jammed into the water pores 6*a* of the inner tub 6 or 42 by centrifugal force, and is entangled. Accordingly, when the cloth is naturally dried after the dehydrating operation, it takes a long time and great labor to disentangle the cloth and to separate the cloth into individual pieces. Further, since the cloth is severely wrinkled due to the high-speed centrifugal dehydration, post-treatment, such as ironing after the dehydrating operation, is required.

Since the cloth still contains a large quantity of moisture even after the dehydrating operation and thus must be dried for a long period of time after the cloth is taken out of the washing machine, the drying of the cloth is restricted by weather and time. When the inner tub 6 or 42 is rotated for a long time in the dehydrating operation, the dehydration degree of the cloth is increased, thereby allowing the natural drying time to be decreased but severely damaging the cloth.

As shown in FIG. 2, the drying device 30 serves to conveniently dry the cloth in the washing machine, but increases the production cost of the washing machine. Further, since it takes approximately 2-3 hours to dry the cloth using the drying device 30, the drying device 30 increases the energy consumption rate. Moreover, since the cloth is dried by hot wind in a closed space inside the washing machine, the cloth has offensive odors and is easily damaged.

DISCLOSURE OF THE INVENTION

Therefore, the present invention has been made in view of the above problems, and it is an object of the present invention to provide a semi-drying method of a washing machine, in which the dehydration and disentanglement of cloth are repeated for a long time at a speed lower than that of a conventional dehydrating operation, and ventilating structure and a control apparatus for the same, thereby having a dehydration degree higher than that of the conventional dehydrating operation and minimizing damage and wrinkling of the cloth.

It is a further object of the present invention to provide a semi-drying method of a washing machine, in which the duration of a semi-drying operation is selected and the state of the semi-drying operation is checked, and a ventilating structure and a control apparatus for the same.

It is another object of the present invention to provide a semi-drying method of a washing machine, in which the ventilation of the inside of the washing machine is performed during the semi-drying operation, and a ventilating structure and a control apparatus for the same, thereby improving the dehydration degree of the cloth.

It is yet another object of the present invention to provide a semi-drying method of a washing machine, in which the ventilation of the inside of the washing machine is constantly performed, and a ventilating structure and a control apparatus for the same, thereby reducing damage to the cloth and offensive odors permeating the cloth even when the cloth is placed inside the washing machine for a long time.

In accordance with one aspect of the present invention, the above and other objects can be accomplished by the provision of a semi-drying method of a washing machine comprising: dehydrating cloth by centrifugal force by rotating a washing tub at an increasing dehydration speed, step-by-step, until the dehydration speed of the washing tub reaches a designated speed, said dehydration of the cloth being repeated plural times; and disentangling cloth by agitatedly rotating the washing tub prior to the next dehydration of the cloth by way of the repetition of the dehydration.

Preferably, the final dehydration speed of the washing tub may be higher than the preceding dehydration speed of the washing tub in each of the repeated dehydrations of the cloth.

Preferably, the initial dehydration speed of the washing tub in each of the repeated dehydrations of the cloth may be higher than the initial dehydration speed of the washing tub in the preceding dehydration of the cloth.

Preferably, each of the repeated dehydrations of the cloth may include pre-dehydrating the cloth by rotating the washing tub at a designated dehydration speed; and main-dehydrating the cloth after the pre-dehydration of the cloth by rotating the washing tub at a dehydration speed higher than that of the pre-dehydration of the cloth.

Further, preferably, the dehydration speed of the washing tub may be increased step-by-step in the main-dehydration of the cloth.

Preferably, the disentanglement of the cloth may be repeated plural times until the eccentricity of the cloth is less than a designated value.

Preferably, the disentanglement of the cloth may be performed one more time prior to the dehydration of the cloth so that the cloth is disentangled before the cloth is dehydrated.

Preferably, the duty value of a motor for rotating the washing tub may be gradually increased during the repetition of the disentanglement of the cloth plural times.

The semi-drying method may further comprise sensing a quantity of the cloth put into the washing tub prior to the dehydration of the cloth.

Preferably, the dehydration of the cloth may be performed when it is determined that the sensed quantity of the cloth is less than a predetermined value in the sensing of the quantity of the cloth; and the operation of the washing machine may be stopped and an alarm indicating the excessive quantity of the cloth may be raised when it is determined that the sensed quantity of the cloth exceeds the predetermined value in the sensing of the quantity of the cloth.

The semi-drying method may further comprise initially disentangling the cloth so that the cloth is disentangled prior to the sense of the quantity of the cloth.

Preferably, the duty value of a motor for rotating the washing tub in the initial-disentanglement of the cloth may be smaller than the duty value of the motor in the disentanglement of the cloth.

The semi-drying method may further comprise finally disentangling cloth after the repetition of the dehydration of the cloth is completed.

In accordance with a further aspect of the present invention, there is provided a control apparatus for controlling a semi-drying method of a washing machine, comprising: an operating unit for inputting a selected washing method to the control apparatus therethrough and displaying a washing state based on the selected washing method thereon; and time setting means provided on the operating unit for setting a duration of a semi-drying operation, in which dehydration and disentanglement of cloth are repeated plural times so that the cloth is dehydrated to a designated degree.

Preferably, the operating unit may include a semi-dry state display for displaying the remaining time of the duration of the semi-drying operation when the semi-drying operation is started.

In accordance with another aspect of the present invention, there is provided a ventilating structure of a washing machine for performing a semi-drying operation, comprising: a door provided with ventilating holes for ventilating a washing tub during the semi-drying operation, in which dehydration and disentanglement of cloth in the washing tub are repeated plural times to dehydrate the cloth to a designated degree; a cover installed on the door for opening or closing the ventilating holes; and regular ventilating means for ventilating the washing tub through the ventilating holes even when the ventilating holes are covered with the cover.

Preferably, the diameter of each of the ventilating holes may be gradually narrowed from the outer surface of the washing tub to the inner surface of the washing tub.

Preferably, the outer edge of each of the ventilating holes may be rounded.

Preferably, a filter for filtering out dust from air passing through the ventilating holes may be installed on the door.

Further, preferably, the filter may include a filter grip for facilitating the installation of the filter; and the filter grip may have a designated height for supporting the cover when the ventilating holes are covered with the cover.

Preferably, the cover may include antiskid means for preventing a user's hand from sliding on the cover when the user grasps the cover.

Preferably, hinge means for rotating the cover in the inward and outward direction of the washing machine may be formed between the cover and the door.

More preferably, the hinge means may include: first bosses, each of which is installed on the door and provided with a pin; second bosses, each of which is installed on the cover and provided with a groove having a partially cut-off portion for rotatably receiving or releasing the pin; and supporting members, each of which is provided on the corresponding one of the second bosses, and locked with the corresponding one of the first bosses when the cover is opened from the door by a designated angle or more to separate the pin from the groove.

Preferably, a hook may be formed on the cover, and inserted into a hook hole formed in the door to lock the cover into the door when the ventilating holes are covered with the cover.

Preferably, the regular ventilating means may be obtained by causing a portion of the rim provided on the inner surface of the cover to have a length from the cover smaller than those of other portions of the rim.

Preferably, a backing-up member for supporting the cover, when the ventilating holes are covered with the cover, may be formed on the door; and the rim may be protruded from the cover by a designated length so that a designated cleavage between the rim and the door is maintained when the ventilating holes are covered with the cover.

Further, preferably, locking means for maintaining the covering of the ventilating holes with the cover may be provided between the cover and the door; and the rim protruded from the cover may have a length longer than the distance between the door and the cover when the ventilating holes may be covered with the cover so that the door compresses the rim when the ventilating holes are covered with the cover.

In accordance with yet another aspect of the present invention, there is provided a ventilating structure of a washing machine for performing a semi-drying operation, comprising: a door provided with ventilating holes; a cover installed on the door for opening or closing the ventilating holes; and regular ventilating means for ventilating the washing tub through the ventilating holes even when the ventilating holes are covered with the cover.

Preferably, the regular ventilating means may be obtained by causing a portion of the rim provided on the inner surface of the cover to have a length from the cover smaller than those of other portions of the rim.

The semi-drying method of the washing machine of the present invention has an improved dehydration degree compared to the conventional dehydrating operation, prevents the cloth from being damaged and wrinkled, and reduces a power consumption rate and a required time.

The control apparatus for controlling the semi-drying method of the washing machine of the present invention allows a user to select the duration of a semi-drying operation according to his/her preference and to directly check the results obtained by the user's selection and the remaining time of the duration of the semi-drying operation.

The ventilating structure of the washing machine for performing the semi-drying operation of the present invention improves the dehydration degree of cloth during the semi-drying operation.

Further, the ventilating structure of the washing machine of he present invention removes offensive odors from the cloth and prevents damage to the cloth although the cloth is left within the washing tub for a long period of time.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of the present invention will be described in detail with reference to the annexed drawings.

First, a washing machine, which carries out a semi-drying method of the present invention, performs a washing operation for removing dirt from cloth, a rinsing operation for rinsing the cloth with clean wash water, a dehydrating operation for rotating a washing tub in a comparatively short time so that the wet cloth is dehydrated by centrifugal force, and a semi-drying operation for dehydrating the cloth at a dehydration degree higher than that of the dehydrating operation by centrifugal force. Accordingly, the dehydrating operation and the semi-drying operation may be selectively performed according to the user's selection when the cloth is dehydrated.

Figure 1:
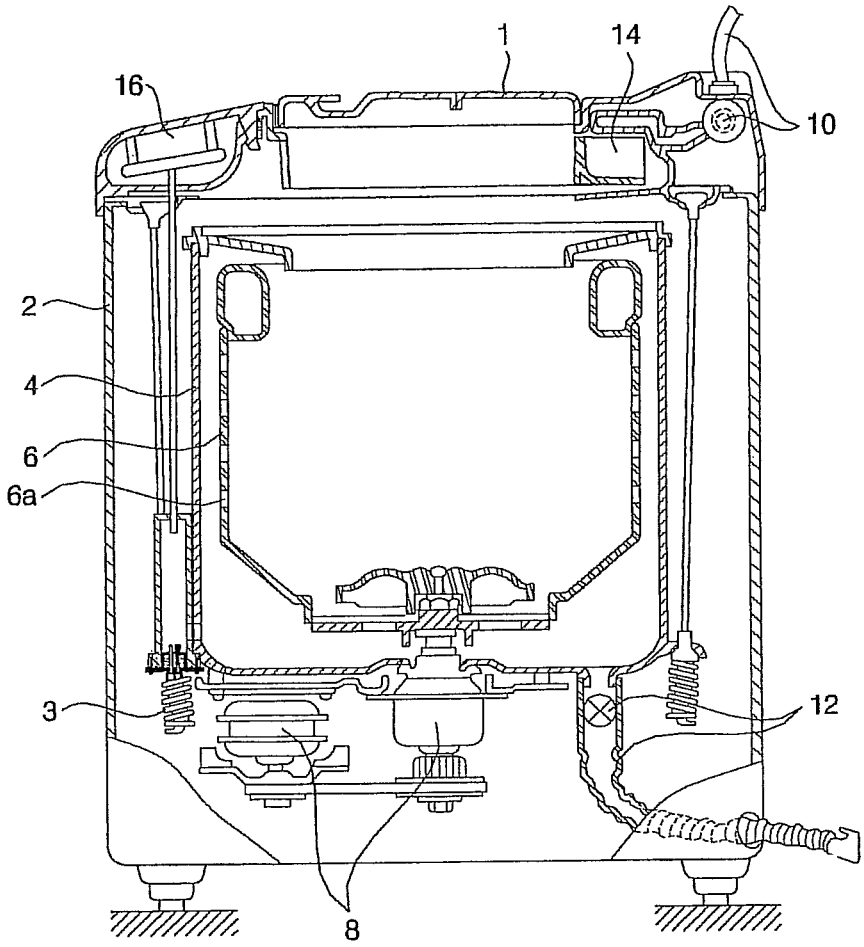
FIG. 1 RELATED ART
FIG. 1 is a longitudinal-sectional view of a conventional fully automatic washing machine.
Figure 2:
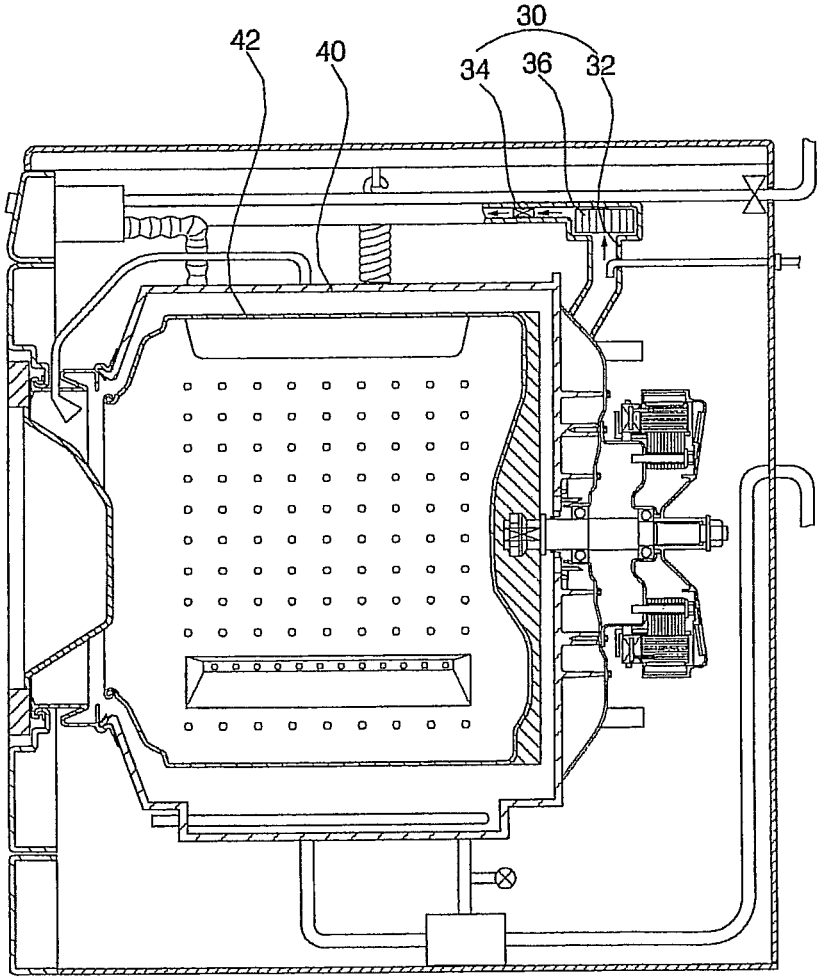
FIG. 2 RELATED ART
FIG. 2 is a longitudinal-sectional view of a conventional washing machine having a drying device.
Figure 3:
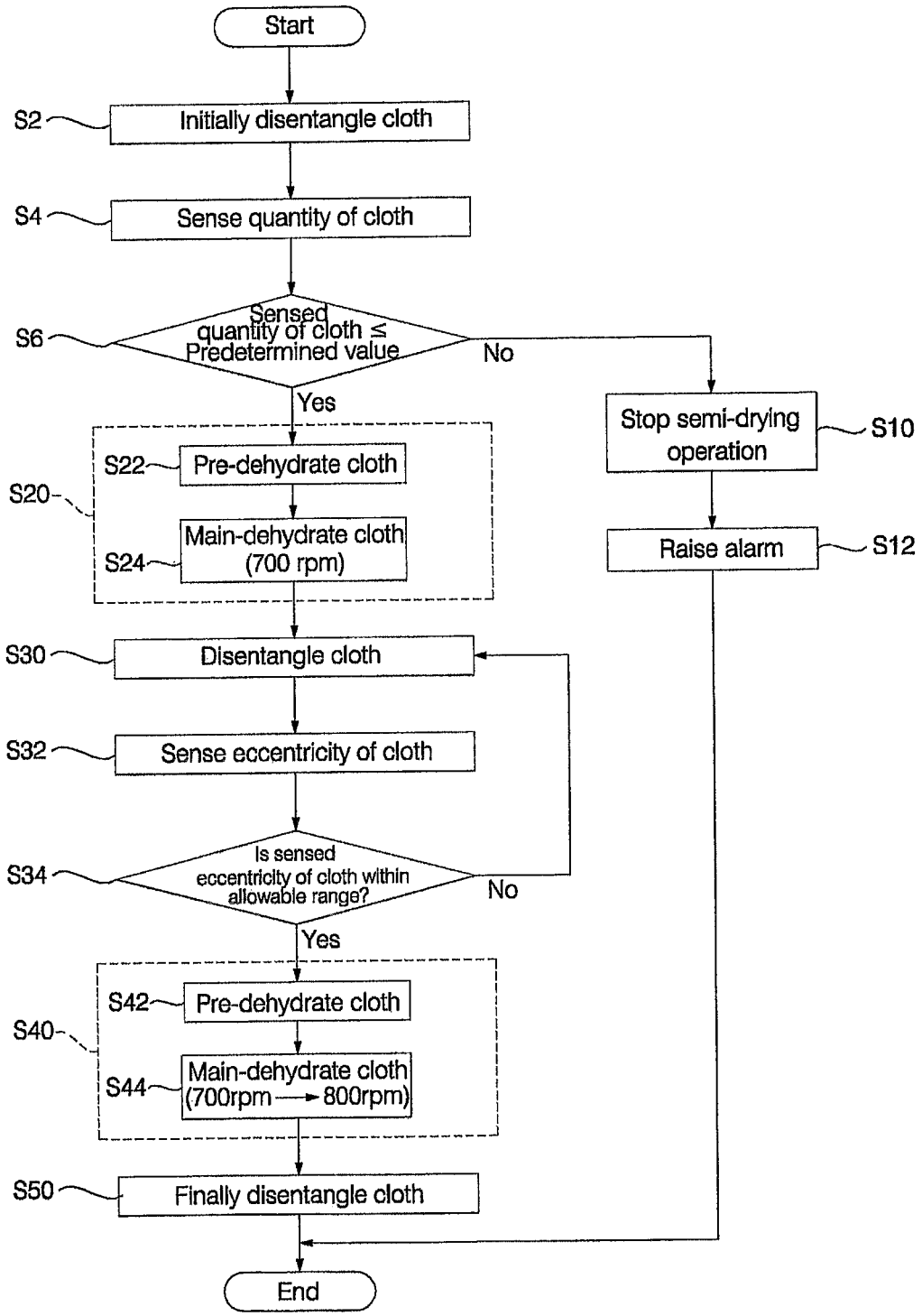
FIG. 3 is a flow chart illustrating a semi-drying method of a washing machine in accordance with one embodiment of the present invention.

FIG. 3 is a flow chart illustrating a semi-drying method of a washing machine in accordance with one embodiment of the present invention.

Hereinafter, with reference to FIG. 3, a semi-drying operation in accordance with one embodiment of the present invention will be described in detail. For reference, in this embodiment, a washing tub is rotated by a motor. More specifically, the washing tub is indirectly connected to the motor by a belt, a pulley, etc., or is directly connected to the motor. Here, although the washing tub is directly connected to the motor, the rotational speed of the washing tub may not be the same as the rotational speed (rpm) of the motor due to the load, etc. However, since the rotational speed of the washing tub is generally the same as or proportionate to the rotational speed (rpm) of the motor, it is considered that the rotational speed of the washing tub is the same as the rotational speed (rpm) of the motor.

First, in case that cloth is entangled and is not placed uniformly in the rotating washing tub, i.e., in case that the eccentricity of the cloth in the washing tub is high, the vibration of the washing tub is excessive. Accordingly, in order to disentangle the cloth, initial cloth-disentangling step (S2), in which the washing tub is agitatedly rotated at a low speed, is performed. In initial cloth-disentangling step (S2), the motor is repeatedly turned on/off based on the duty value thereof. For reference, the duty value of the motor is the ratio of the turning-on time of the motor to the turning-off time of the motor.

After initial cloth-disentangling step (S2) is completed, quantity-sensing step (S4), in which a quantity of the cloth put into the washing tub is sensed, is performed. Quantity-sensing step (S4) is performed by general methods including a method for sensing the quantity of the cloth by detecting a time taken of the rotational speed of the washing tub to reach a predetermined speed.

After the quantity of the cloth is sensed in quantity-sensing step (S4), it is determined whether or not a semi-drying operation is continued by comparing the sensed quantity of the cloth to a predetermined value, which is the maximum quantity of the cloth for allowing the semi-drying operation (S6). When the washing tub is rotated so that the cloth is dehydrated by centrifugal force under the condition that a large quantity of the cloth is put into the washing tub, the cloth is easily entangled and the washing tub is excessively vibrated. Thus, it is necessary to restrict the maximum quantity of the cloth for allowing the semi-drying operation. Preferably, the maximum quantity of the cloth for allowing the semi-drying operation is 20% to 40% of a washing capacity in a washing operation of a rinsing operation.

Here, in case that the sensed quantity of the cloth exceeds the predetermined value, the semi-drying operation is not continued and stopped (S10). Further, an alarm is raised to inform a user of the stoppage of the semi-drying operation due to the excessive quantity of the cloth (S12).

On the other hand, in case that the sensed quantity of the cloth is less than the predetermined value, first dehydrating step (S20), in which the semi-drying operation is continued and the washing tub is rotated at a designated dehydration speed so that the cloth is dehydrated by centrifugal force, is performed.

Here, when the washing tub is rotated at the designated speed, in case that the cloth is wet at a high rate, a high degree of centrifugal force is applied to the cloth and the washing tub is vibrated at a high degree. Accordingly, preferably, the dehydration speed of the washing tub is gradually increased until it reaches a designated speed.

Pre-dehydrating step (S22), in which the washing tub is rotated at a comparatively low dehydration speed so as to minimize the jamming of the cloth, dehydrated by centrifugal force, into the water pores formed through the wall of the washing tub, is performed.

Thereafter, main-dehydrating step (S24), in which the washing tub is rotated at a dehydration speed higher than that of pre-dehydrating step (S22), is performed. In main-dehydrating step (S24) of first dehydrating step (S20), the dehydration speed of the washing tub is set to approximately 700 rpm so as to minimize the jamming of the cloth into the water pores of the washing tub.

Here, the hydration speed of the washing tub in first dehydrating step (S20) is lower than that of the above-described dehydrating operation so as to minimize the jamming of the cloth into the water pores of the washing tub. Since the low hydration speed of the washing tub in first dehydrating step (S20) scarcely damages the cloth, the duration of first dehydrating step (S20) is longer than that of the above general dehydrating operation so that the cloth is sufficiently dehydrated. Here, the duration of first dehydrating step (S20) is suitably 5 minutes to 30 minutes.

Since the cloth is entangled and eccentrically placed in the washing tub during first dehydrating step (S20), cloth-disentangling step (S30), in which the cloth in the washing tub is disentangled, is performed after first dehydrating step (S20).

In the same manner as initial cloth-disentangling step (S2), in cloth-disentangling step (S30), the washing tub is agitatedly rotated at a low speed by the operation of the motor, which is repeatedly turned on/off based on the duty value of the motor.

After cloth-disentangling step (S30) is performed for a designated time, eccentricity-sensing step (S32), in which the eccentricity of the cloth is sensed by an eccentricity-sensing unit for determining whether or not the cloth is disentangled, is performed. Then, it is determined whether or not the eccentricity of the cloth sensed in eccentricity-sensing step (S32) is within an allowance range (S34).

Here, in case that the eccentricity of the cloth exceeds the allowance range, cloth-disentangling step (S30) is performed again for a designated time, and then eccentricity-sensing step (S32) is performed again. Cloth-disentangling step (S30) and eccentricity-sensing step (S32) are repeated plural times until the eccentricity of the cloth reaches the allowance range.

Thereafter, in case that the eccentricity of the cloth sensed in eccentricity-sensing step (S32) is within the allowance range, second dehydrating step (S40), in which the cloth is dehydrated at a dehydration degree higher than that in first dehydrating step (S20) by centrifugal force, is performed.

In the same manner as first dehydrating step (S20), second dehydrating step (S40) includes pre-dehydrating step (S42), in which the cloth is dehydrated in the same manner as pre-dehydrating step (S22), and main-dehydrating step (S44), in which the washing tub is rotated at a dehydration speed higher than that of pre-dehydrating step (S42) so that the cloth is dehydrated to a high degree. Of course, the dehydration speed of the washing tub of pre-dehydrating step (S42) is set so as to minimize the jamming of the cloth into the water pores of the washing tub.

Since the cloth was dehydrated to a designated dehydration degree through first dehydrating step (S20), although the washing tub in second dehydrating step (S40) is rotated at a speed higher than that of the washing tub in first dehydrating step (S20), it is possible to minimize the jamming of the cloth into the water pores of the washing tub. Accordingly, in main-dehydrating step (S44) of second dehydrating step (S40), the final dehydration speed of the washing tub is set to be at least higher than the preceding dehydration speeds of the washing tub, thereby maximizing the dehydration degree of the cloth and minimizing the dehydration time of the cloth. For example, in main-dehydrating step (S44) of second dehydrating step (S40), the washing tub is first rotated at a speed of 700 rpm for a designated time, and is then rotated at a speed of 800 rpm for the remaining time of the duration. Here, similarly to first dehydrating step (S20), the duration of second dehydrating step (S40) is longer than that of the general dehydrating operation.

Second dehydrating step (S40) may be repeated plural times so as to dehydrate the cloth to the higher dehydration degree. In case that second dehydrating step (S40) is repeated plural times, preferably, the cloth is disentangled before next second dehydrating step (S40) is performed.

After last second dehydrating step (S40) is completed, final cloth-disentangling step (S50), in which the cloth is disentangled and is separated from the wall of the washing tub, is performed.

In final cloth-disentangling step (S50), the washing tub is agitatedly rotated at a low speed by the operation of the motor, which is repeatedly turned on/off based on the duty value of the motor.

After final cloth-disentangling step (S50) is completed, the semi-drying operation in accordance with one embodiment of the present invention is terminated.

Figure 4:
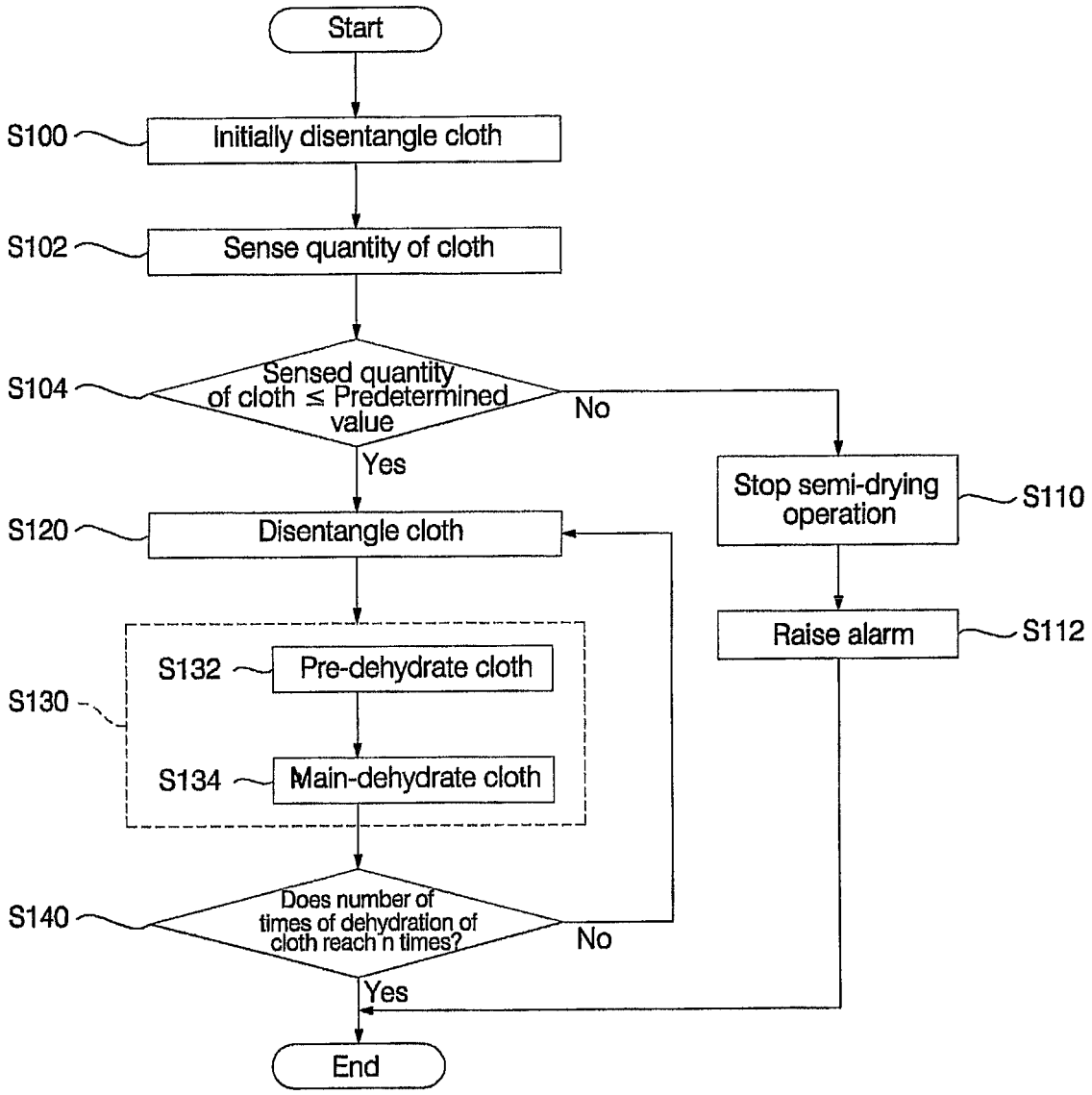
FIG. 4 is a flow chart illustrating a semi-drying method of a washing machine in accordance with another embodiment of the present invention.
Figure 5:
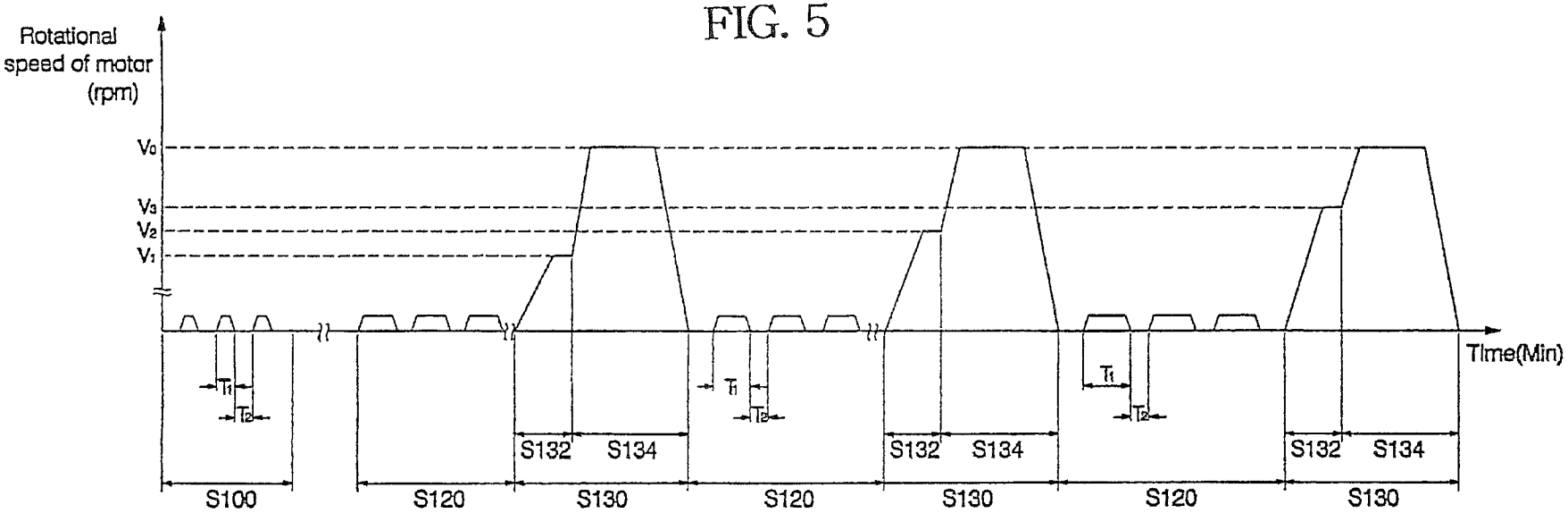
FIG. 5 is a graph illustrating the relation between time (min) and rotational speed of a motor (rpm) in the semi-drying method of the washing machine in accordance with another embodiment of the present invention.

FIG. 4 is a flow chart illustrating a semi-drying method of a washing machine in accordance with another embodiment of the present invention, and FIG. 5 is a graph illustrating the relation between time (min) and rotational speed of a motor (rpm) in the semi-drying method of the washing machine in accordance with another embodiment of the present invention.

Hereinafter, with reference to FIGS. 4 and 5, a semi-drying operation in accordance with another embodiment of the present invention will be described in detail. For reference, the semi-drying operation of this embodiment is partially the same as that of the earlier embodiment shown in FIG. 3, and thus a detailed description thereof will be omitted.

When the semi-drying operation is started, initial cloth-disentangling step (S100), in which the washing tub is agitatedly rotated at a low speed by the operation of the motor, which is repeatedly turned on/off based on the duty value of the motor, i.e., $T_1/T_2$, is performed so that the cloth in the washing tub is disentangled.

Here, since the cloth in a wet state has a weight larger than that of the cloth in a dry state and is entangled more than the cloth in the dry state, the washing tub is excessively vibrated as well as a comparatively large burden is applied to the motor, when the washing tub is rotated. Accordingly, preferably, the duty value of the motor is set to a small value so that the washing tub is rotated at a low speed in a short time.

After initial cloth-disentangling step (S100) is completed, a quantity of the cloth put into the washing sub is sensed (S102), and the sensed quantity of the cloth is compared to a predetermined value, i.e., the maximum quantity of the cloth for allowing the semi-drying operation (S104).

Here, in case that the sensed quantity of the cloth exceeds the predetermined value, the semi-drying operation is stopped (S110), and an alarm is raised to inform a user of the stoppage of the semi-drying operation (S112).

On the other hand, in case that the sensed quantity of the cloth is less than the predetermined value, cloth-disentangling step (S120), in which the washing machine is agitatedly rotated at a low speed by the operation of the motor, which is repeatedly turned on/off based on the duty value of the motor, is performed.

Since the disentanglement of the cloth was performed once by the initial cloth-disentangling step (S100), the duty value of the motor in the cloth-disentangling step (S120) is set to be larger than that of the motor in initial cloth-disentangling step (S100) so that the cloth is sufficiently disentangled. That is, the turning-on time ($T_1$) of the motor in the cloth-disentangling step (S120) is longer than that of the motor in the initial cloth-disentangling step (S100).

After cloth-disentangling step (S120) is completed, dehydrating step (S130), in which the washing tub is rotated at a designated dehydration speed so that the cloth in the washing tub is dehydrated by centrifugal force, is performed.

Dehydrating step (S130) includes pre-dehydrating step (S132), in which the cloth is dehydrated at comparatively low speeds ($V_1$, $V_2$ and $V_3$), and a main-dehydrating step (S134), in which the washing tub is rotated at a dehydration speed higher than those of pre-dehydrating step (S132).

Here, the dehydration speed of the washing tub in dehydrating step (S130) is set so as to minimize the jamming of the cloth into the water pores of the washing tub, and the duration of dehydrating step (S130) is longer than that of the general dehydrating operation so as to sufficiently dehydrate the cloth.

Thereafter, cloth-disentangling step (S120) and dehydrating step (S130) are alternately repeated plural times so that the cloth is dehydrated to a higher dehydration degree until the number of times of the repetition of dehydrating step (S130) reaches a predetermined number (S140).

Here, as cloth-disentangling step (S120) and dehydrating step (S130) are repeated plural times, the dehydration degree of the cloth is gradually increased. Accordingly, preferably, the duty value of the motor in present cloth-disentangling step (S120) is set to be larger than that of the motor in preceding cloth-disentangling step (S120).

Preferably, the dehydration speed of the washing tub in pre-dehydrating step (S132) of present dehydrating step (S130) is set to be higher than that of the washing tub in pre-dehydrating step (S132) of preceding dehydrating step (S130). Thereby, it is possible to minimize damage to the cloth, maximize the dehydration degree of the cloth, and to minimize the dehydration time of the cloth.

After last dehydrating step (S140) is completed, the semi-drying operation in accordance with another embodiment of the present invention is terminated.

Hereinafter, functions and effects of the above-described semi-drying method of the present invention will be described as follows.

In the dehydrating operation of the semi-drying method of the present invention, the cloth is dehydrated by centrifugal force. Here, the washing tub is rotated for several minutes such that the dehydration speed of the washing tub is gradually increased to a designated speed step by step so as to minimize the jamming of the cloth into the water pores of the washing tub. The above dehydrating operation is repeated plural times so that the cloth is dehydrated to a dehydration degree of 55~70%, and the disentanglement of the cloth is performed by way of the repetition of the dehydrating operation.

Accordingly, the cloth dehydrated by the semi-drying operation of the present invention is not damaged and wrinkled, and has a dehydration degree higher than that of a general dehydrating operation, thereby allowing the cloth to be wearable and usable just after post-treatment, such as ironing, as well as causing the cloth to be naturally dried indoors/outdoors in a short time.

Further, since the total duration of the semi-drying operation of the present invention is approximately several minutes, the semi-drying operation of the present invention has a reduced power consumption rate compared to the drying operation of the conventional washing machine provided with a drying device, removes offensive odors from the cloth, and requires the total washing time for the washing operation to the drying operation, being shorter than a time for the drying operation of the drier of the conventional washing machine or a time for the dehydrating operation of the conventional washing machine.

Hereinafter, a control apparatus for controlling a semi-drying operation in accordance with the semi-drying method of the washing machine of the present invention will be described, and a detailed description of the semi-drying operation will be omitted because it is considered to be unnecessary.

Figure 6:
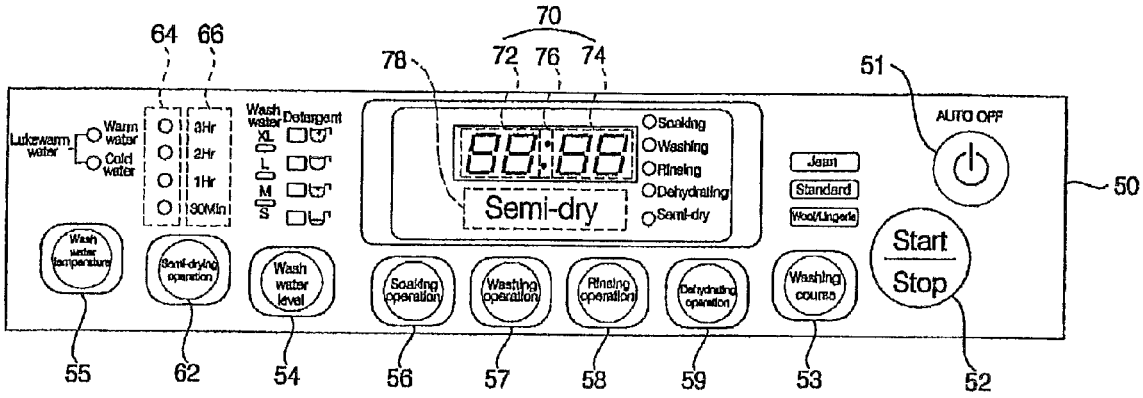
FIG. 6 is a schematic view of a control apparatus for controlling a semi-drying operation of a washing machine in accordance with one embodiment of the present invention.

FIG. 6 is a schematic view of a control apparatus for controlling a semi-drying operation of a washing machine in accordance with one embodiment of the present invention.

The control apparatus for controlling the semi-drying operation of the washing machine of the present invention comprises an operating unit 50 for inputting a selected washing method to the washing machine therethrough and displaying a washing state based on the selected washing method thereon, and semi-dry time setting means provided on the operating unit 50 for allowing a user to set a duration for performing the semi-drying operation.

The operating unit 50 includes a power button 51, a start/stop button 52, a washing course button 53 for selecting a washing course according to the contaminated degree of laundry, a wash water level button 54 for selecting the level of wash water, a wash water temperature button 55 for selecting one of warm water, lukewarm water and cold water, a display for displaying the washing state of the laundry thereon, a soaking operation button 56, a washing operation button 57, a rinsing operation button 58, and a dehydrating operation button 59. Further, the operating unit 50 includes light emitting devices for displaying the washing state of the laundry, and indicators including seven segments.

The semi-dry time setting means includes a semi-dry time setting button 62 for inputting the semi-drying operation of the present invention to the control apparatus therethrough and setting the duration of the semi-drying operation therethrough. The duration of the semi-drying operation is set by the number of times the semi-dry time setting button 62 is manipulated.

For example, when the semi-dry time setting button 62 is manipulated once, the duration of the semi-drying operation is set to 30 minutes, when the semi-dry time setting button 62 is manipulated twice, the duration of the semi-drying operation is set to 1 hour, when the semi-dry time setting button 62 is manipulated three times, the duration of the semi-drying operation is set to 2 hours, and when the semi-dry time setting button 62 is manipulated four times, the duration of the semi-drying operation is set to 3 hours. When the semi-dry time setting button 62 is manipulated more than five times, the duration of the semi-drying operation is set again to 30 minutes to 3 hours sequentially.

The surface of the above semi-dry time setting button 62 is printed with a 'semi-dry' symbol to indicate the button 62, and the semi-dry time setting button 62 has a color differing from those of other buttons provided on the operating unit 50 so as to be easily seen by a user.

The semi-dry time setting means further includes a semi-dry display for displaying the manipulating result using the above semi-dry time setting button 62 to the user.

The semi-dry display includes semi-dry light emitting devices 64 for selectively emitting light based on the number of times the semi-dry time setting button 62 is manipulated, and semi-dry time symbols 66 printed alongside the semi-dry light emitting devices 64 for displaying the set duration of the semi-drying operation when the semi-dry light emitting devices 64 selectively emit light. The semi-dry time symbols 66 include a symbol '30 Min' printed alongside the semi-dry light emitting device 64, which emits light when the semi-dry time setting button 62 is manipulated once, a symbol '1 Hr' printed alongside the semi-dry light emitting device 64, which emits light when the semi-dry time setting button 62 is manipulated twice, a symbol '2 Hr' printed alongside the semi-dry light emitting device 64, which emits light when the semi-dry time setting button 62 is manipulated three times, and a symbol '3 Hr' printed alongside the semi-dry light emitting device 64, which emits light when the semi-dry time setting button 62 is manipulated four times.

Accordingly, when any one of the semi-dry light emitting devices 64 is selected based on the number of times the semi-dry time setting button 62 is manipulated and then the selected semi-dry light emitting device 64 emits light, the user can see the set duration of the semi-drying operation through the semi-dry time symbols 66 printed alongside the above selected semi-dry light emitting device 64.

The semi-dry time setting means further includes a semi-dry state display 70 for displaying the remaining time of the duration of the semi-drying operation based on the set duration of the semi-drying operation from when the semi-drying operation is started.

For example, the semi-dry state display 70 is formed in segments. That is, the semi-dry state display 70 includes a first dual segment indicator 72 having a pair of 2 seven-segments for displaying hours remaining in Arabic numerals, a second dual segment indicator 74, positioned alongside the first dual segment 72, having a pair of 2 seven-segments for displaying minutes remaining in Arabic numerals, and circular segment indicators 76 placed between the first dual segment 72 and the second dual segment 74 for separating the first dual segment 72 and the second dual segment 74. The circular segment indicators 76 are repeatedly turned on/off each second during the semi-drying operation. When any operations other than the semi-drying operation are performed, the remaining time of the duration of the performed operation may be displayed on the semi-dry state display 70.

The semi-dry time setting means further includes a semi-dry state symbol unit 78 for emitting a 'semi-dry' symbol so as to inform the user of the state of the semi-drying operation during the semi-drying operation.

Hereinafter, operation of the control apparatus for controlling the semi-drying method of the washing machine of this embodiment of the present invention will be described.

When a user manipulates the semi-dry time setting button 62, instructions for the semi-drying operation to are inputted into the control apparatus. Simultaneously, the duration of the semi-drying operation is set and any one of the semi-dry light emitting devices 64 is selected according to the number of times the semi-dry time setting button 62 is manipulated, and the selected semi-dry light emitting device 64 emits light. Then, the user sees the duration of the semi-drying operation, which is set according to the user's selection, through the semi-dry time symbol 66 placed alongside the selected semi-dry light emitting device 64, which emits light due to the user's manipulation of the semi-dry time setting button 62.

When the semi-drying operation of the present invention is started, the semi-dry state display 70 displays the remaining time of the duration of the semi-drying operation set through the semi-dry time setting button 62 from when the semi-drying operation is started. Simultaneously, the semi-dry state symbol unit 78 is operated during the semi-drying operation, thereby clearly displaying the 'semi-dry' symbol.

Figure 7:
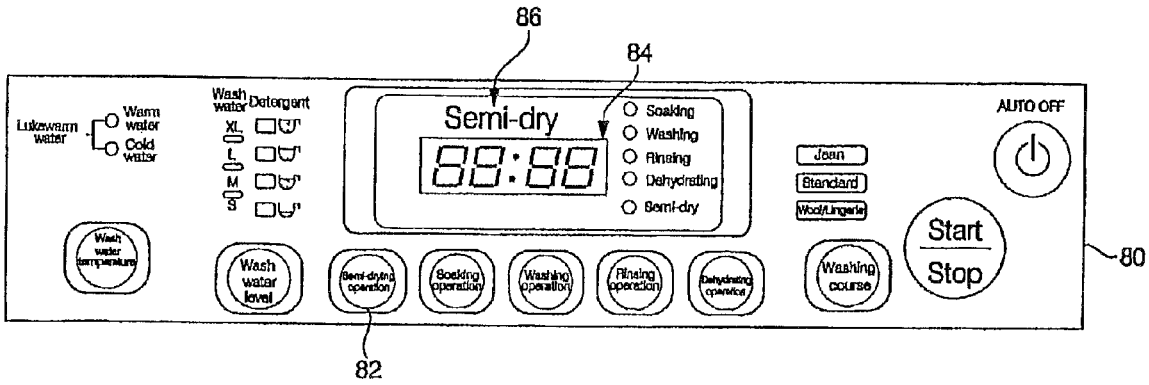
FIG. 7 is a schematic view of a control apparatus for controlling a semi-drying operation of a washing machine in accordance with another embodiment of the present invention.

FIG. 7 is a schematic view of a control apparatus for controlling a semi-drying operation of a washing machine in accordance with another embodiment of the present invention. Parts of the control apparatus of this embodiment shown in FIG. 7 are substantially the same as those of the control apparatus of the earlier embodiment shown in FIG. 6, and detailed descriptions and reference numerals thereof will be thus omitted.

Hereinafter, with reference to FIG. 7, the control apparatus for controlling the semi-drying method of the washing machine in accordance with another embodiment of the present invention will be described. An operating unit 80 includes a semi-dry time setting button 82 for inputting the semi-drying operation of the present invention to the control apparatus therethrough and setting the duration of the semi-drying operation therethrough. The operating unit 80 further includes a semi-dry time display 84, formed in segments, for displaying the manipulated results of the semi semi-dry time setting button 82 and the remaining time of the duration of the semi-drying operation.

The operation unit 80 further includes a semi-dry state symbol unit 86 for emitting a 'semi-dry' symbol during the semi-drying operation.

Hereinafter, operation of the control apparatus for controlling the semi-drying method of the washing machine of this embodiment of the present invention will be described.

When a user manipulates the semi-dry time setting button 82, instructions for the semi-drying operation are inputted into the control apparatus. Simultaneously, the duration of the semi-drying operation is set according to the number of times the semi-dry time setting button 82 is manipulated, and the set duration of the semi-drying operation is displayed on the semi-dry time display 84. The semi-dry time display 84 displays the set duration of the semi-drying operation only for a predetermined time.

Thereafter, when the semi-drying operation of the present invention is started, the semi-dry time display 84 displays the remaining time of the duration of the semi-drying operation and the semi-dry state symbol unit 86 is operated.

The above control apparatus for controlling the semi-drying method of the washing machine allows the user to select the duration of the semi-drying operation according to his/her preference, directly displays results obtained by the user's selection, and allows the user to see the remaining time of the duration of the semi-drying operation during the semi-drying operation.

Hereinafter, a ventilating structure for the semi-drying method of the washing machine of the present invention will be described. The ventilating structure is a device for improving effects of the semi-drying operation of the present invention, and a detailed description of the semi-drying operation will be omitted because it is considered to be unnecessary.

Figure 8:
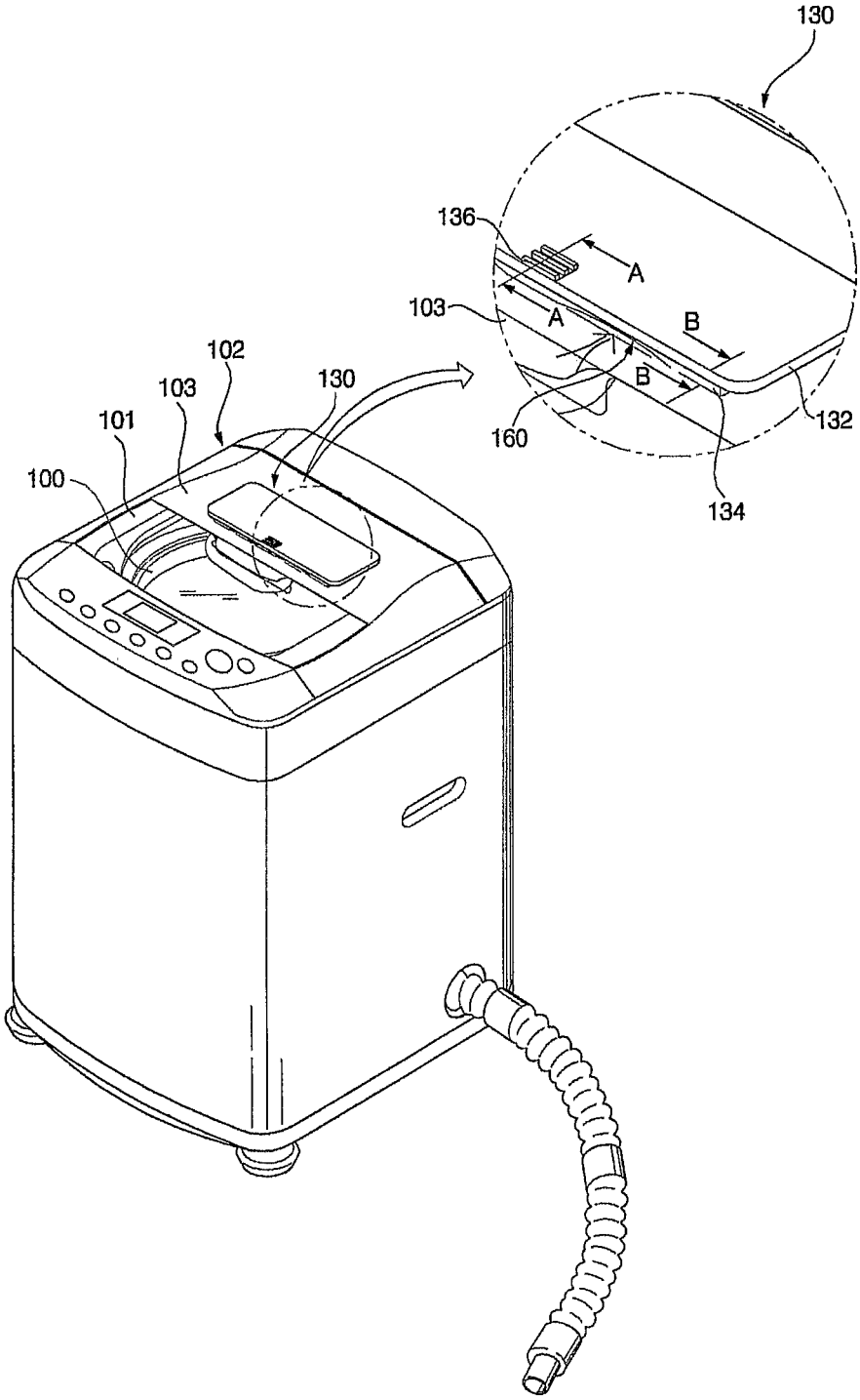
FIG. 8 is a perspective view of a ventilating structure of the washing machine of the present invention.
Figure 12:
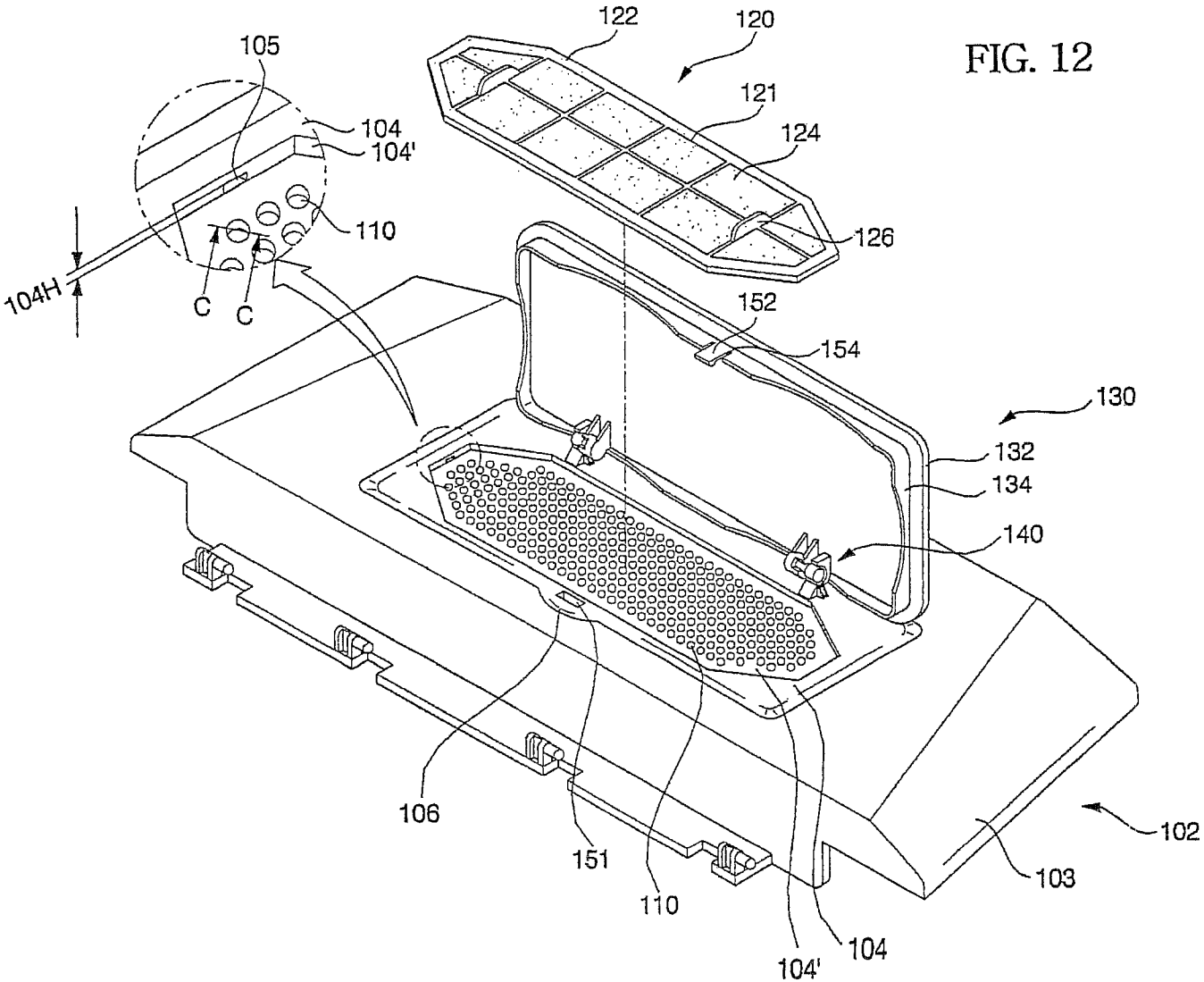
FIG. 12 is an exploded perspective view of the ventilating structure of the washing machine of the present invention.
Figure 17:
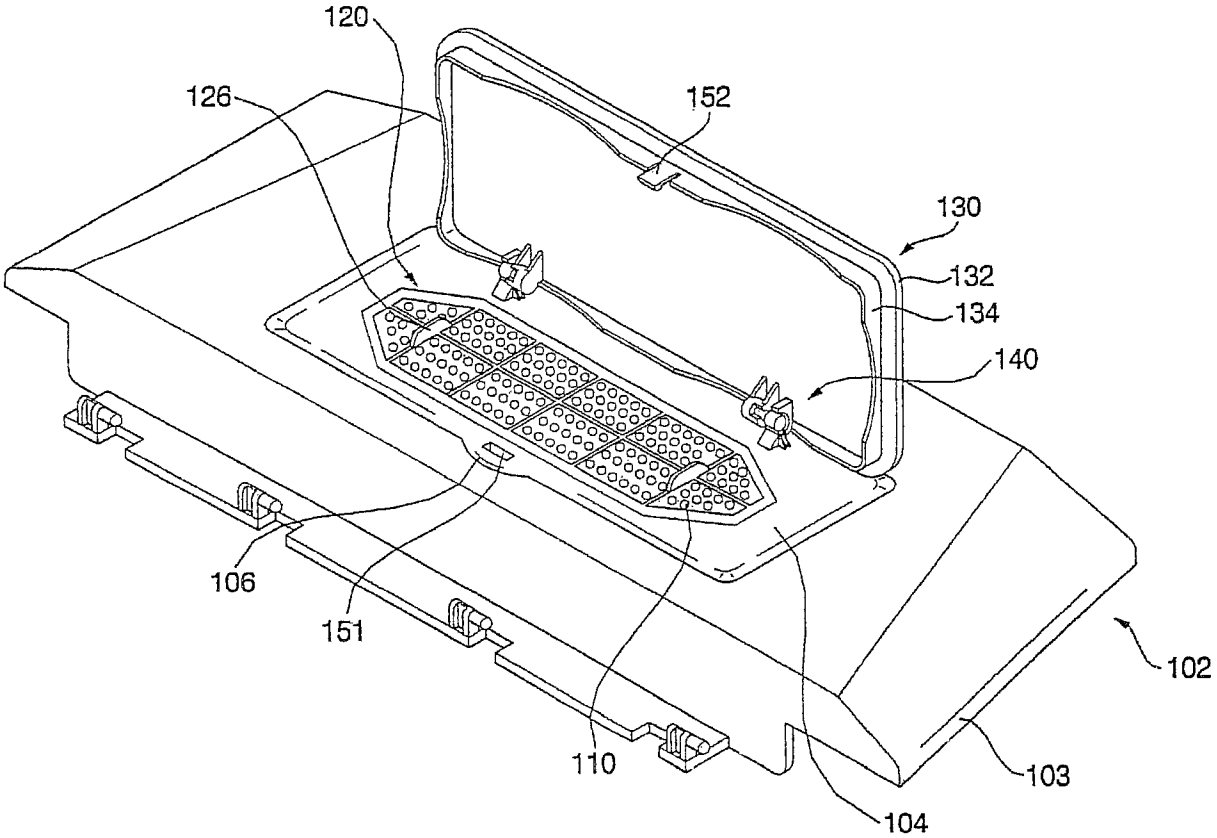
FIG. 17 is an assembled perspective view of the ventilating structure of the washing machine of the present invention.

FIG. 8 is a perspective view of a ventilating structure of the washing machine of the present invention. FIG. 12 is an exploded perspective view of the ventilating structure of the washing machine of the present invention, and FIG. 17 is an assembled perspective view of the ventilating structure of the washing machine of the present invention.

The ventilating structure of the washing machine of the present invention comprises a door 102 for opening and closing a washing tub of the washing machine so that air is circulated into the washing tub therethrough during the semi-drying operation, and at least one ventilating hole 110 formed through the door 102.

The door 102 is divided into a front panel 101 and a rear panel 103 in a direction of opening and closing the washing tub 100. When the door 102 is opened from the washing tub 100, the door 102 is folded such that the front panel 101 and the rear panel 103 overlap. The front panel 101 includes a transparent window for allowing a user to see the inside of the washing tub 100 therethrough, and a handgrip for manipulating the door 102. Thus, preferably, in order to minimize the interference between the ventilating hole 110 and the surrounding environment, the ventilating hole 110 is formed through the rear panel 103 of the door 102.

A portion of the door 102, through which at least one ventilating hole 110 is formed, is an indented groove having a rectangular shape. Hereinafter, the above portion of the door 102 is referred to as a "ventilating panel portion 104".

Figure 13:
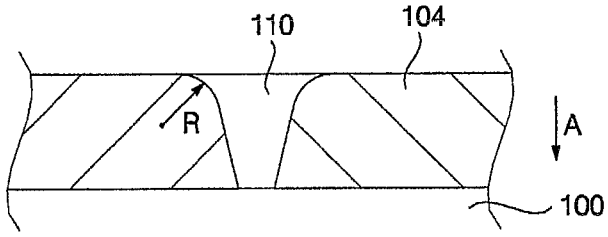
FIG. 13 is a sectional view taken along the line C-C of FIG. 12.

With reference to an enlarged portion of FIG. 12, and FIG. 13, the structure of the ventilating hole 110 will be described. The ventilating hole 110 has a fine pore size so that cloth put into the washing tub 100 is not taken out through the ventilating hole 110. Preferably, in order to sufficiently circulate air into the washing tub 100, a plurality of the ventilating holes 110 are distributed at a designated portion of the door 102.

An outer edge of each of the ventilating holes 110 is rounded to have a designated radius (R) so as to minimize resistance caused by the flow of air from the outside of the washing tub 100 to the ventilating holes 110, and the diameter of each of the ventilating holes 110 is decreased in a direction (shown by the arrow A) of circulating air into the washing tub 100 so as to increase the flow rate of air from the outside of the washing tub 100 to the inside of the washing tub 100.

The ventilating holes 110 efficiently circulate external air, which is drier than the wet air inside the washing tub 100, into the washing tub 100 in the semi-drying operation, thereby causing the cloth in the washing tub 100 to be sufficiently dehydrated by natural drying through ventilation as well as the dehydration through centrifugal force.

A filter 120 for preventing external foreign substances from entering into the washing tub 100 through the ventilating holes 110 is installed above the ventilating holes 110.

With reference to FIGS. 12 and 17, the filter 120 includes a filter frame 122 made by injection molding and provided with a plurality of holes 121, each of which has a diameter larger than that of each of the ventilating holes 110, to accommodate all the plural ventilating holes 110, and filter nets 124 inserted into the holes 121 of the filter frame 122 when the filter frame 122 is made by injection molding. The filter nets 124 are made of iron or fabric, such as a Hepa filter paper.

In order to install the filter 120 above the ventilating holes 110, a filter groove 104' having the same shape as that of the filter 120 is formed in the bottom of the ventilating panel portion 104 provided with the ventilating holes 110, and the filter 120 is inserted into the filter groove 104'.

Here, when the filter 120 is inserted into the filter groove 104' having the same shape as that of the filter 120, as shown in FIG. 17, the outer surface of the filter 120 is paralleled with the bottom of the ventilating panel portion 104, thereby allowing the ventilating structure to have a clean external appearance and not interfering with the surrounding environment. Further, the filter 120 is firmly inserted into the filter groove 104' without using any additional component, such as a bolt, and is easily separated from the filter groove 104', thereby being simply cleaned and replaced with a new one.

Here, a filter grip 126 for facilitating the insertion or separation of the filter 120 into or from the filter groove 104' is provided on the filter 120. Preferably, the filter grip 126 is formed integrally with the filter frame 122 when the filter frame 122 is made by injection molding.

Water supplied into the washing tub 100 remains in an area between the filter 120 and the filter groove 104'. Particularly, with reference to the enlarged portion of FIG. 12, a water hole 105 for discharging the above remaining water to the inside of the washing tub 100 is formed through the wall of the filter groove 104', thereby preventing the area between the filter 120 and the filter groove 104' from being incrusted with slime. The water pore 105 is positioned at a designated height 104H from the bottom of the filter groove 104, and preferably at a height lower than that of the filter groove 104'.

The ventilating structure of the washing machine of the present invention further comprises a cover 130 for opening and closing the ventilating holes 110.

With reference to FIGS. 8, 9, 12 and 17, the cover 130 includes a rectangular panel 132 having dimensions larger than those of the ventilating panel portion 104, and a rim 134, having a ringed structure, formed on the inner surface of the rectangular panel 132.

The rectangular panel 132 of the cover 130 includes anti-skid means 136 for preventing a user's hand from sliding on the cover 130 when the user grasps the cover 130. Particularly, with reference to the enlarged portion of FIG. 8, and FIG. 9, the antiskid means 136 has a plurality of prominent and depressed parts on a portion of the rectangular panel 132 of the cover 130.

The rim 134 of the cover 130 is positioned at an area indented inwardly from the edge of the rectangular panel 132 of the cover 130 by a designated distance so that the rim 134 is inserted into the ventilating panel portion 104 when the ventilating holes 110 are covered with the cover 130, and has a designated height so that the rectangular panel 132 of the cover 130 does not contact the door 102. Accordingly, the user grasps the edge of the rectangular panel 132 of the cover 130, hereby being capable of opening and closing the cover 130.

Here, an arc-shaped cover-removable groove 106 connected to the ventilating panel portion 104 for allowing the user to easily grip the rectangular panel 132 of the cover 130 is formed in the door 102 (with reference to FIG. 12).

In order to open and close the cover 130 under the condition that the cover 130 is not separated from the door 102, hinge means 140 for rotating the cover 130 to the inside and outside of the washing machine is formed between the cover 130 and the door 102.

Figure 14:
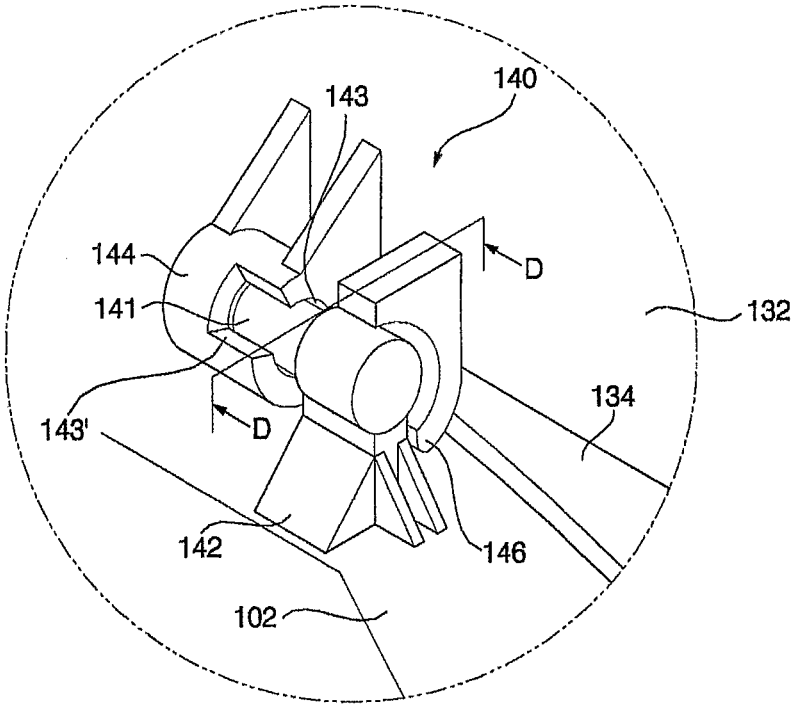
FIG. 14 is an enlarged view of hinge means shown in FIG. 12.
Figure 15:
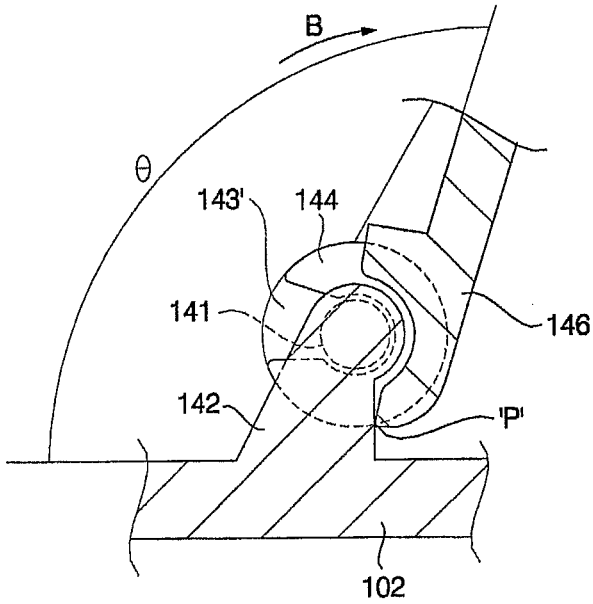
FIG. 15 is a sectional view taken along the line D-D of FIG. 14.
Figure 16:
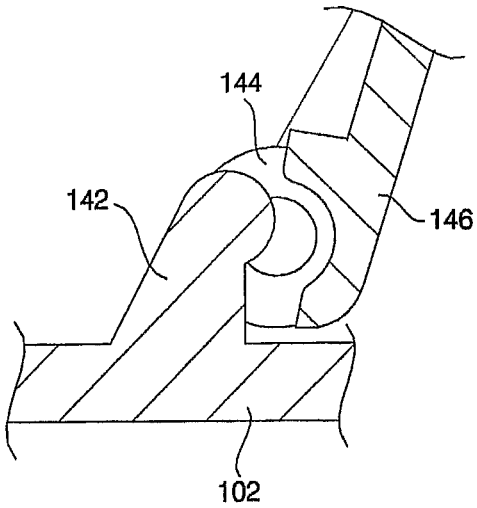
FIG. 16 is a sectional view illustrating the operation of the hinge means shown in FIG. 12.

With reference to FIGS. 14 and 15, the hinge means 140 includes first bosses 142, each of which is installed on the door 102 and provided with a pin 141, and second bosses 144, each of which is installed on the cover 130 and provided with a groove 143 for rotatably receiving the pin 141.

The first bosses 142, in a pair, are separated from each other in a direction (shown by arrow S) of a hinge shaft, through which the cover 130 is opened and closed, and the pins 141 of the first bosses 142 are protruded toward each other. The second bosses 144, in a pair, correspond to the first bosses 142, in a pair.

In order to easily insert or separate the pin 141 of the first boss 142 into or from the groove 143 of the second boss 144, the groove 143 of each of the second bosses 144 includes a cut-off portion 143' at a designated portion of the circumference of the groove 143.

Here, preferably, the cover 130 and the door 102 are made of plastic, and the cut-off portion 143' of the second boss 144 has a width in the circumferential direction of the groove 143 of the second boss 144 slightly smaller than the diameter of the pin 141 of the second boss 144. Since the pin 141 of the first boss 142 is inserted into the groove 143 of the second boss 144 by interference fit, the pin 141 of the first boss 142 is not easily separated from the groove 143 of the second boss 144.

The hinge means 140 further includes supporting members 146, each of which is formed integrally with each of the second bosses 144, locked with each of the first bosses 142 when the cover 130 is opened from the door 102 by a designated angle (θ).

That is, when the cover 130 is more rotated in an opening direction (shown by arrow B) of the cover 130 under the condition that the supporting member 146 is locked with the first boss 142 as shown in FIG. 15, the supporting member 146 is supported by a point ('P') of the first boss 142, thereby separating the pin 141 of the first boss 142 from the groove 143 of the second boss 144 through the cut-off portion 143' of the second boss 144.

Then, when the cover 130 is opened from the door 102, the cover 130 is easily separated from the door 102, thereby allowing articles to be placed on the rear portion of the door 102, preventing the cover 130 from interfering with the surrounding environment of the washing machine, and preventing the cover 130 from interrupting one side of a ventilating route.

The ventilating structure of the washing machine of the present invention further comprises locking means 150 installed between the cover 130 and the door 102 for securely covering the ventilating holes 110 with the cover 130.

Figure 9:
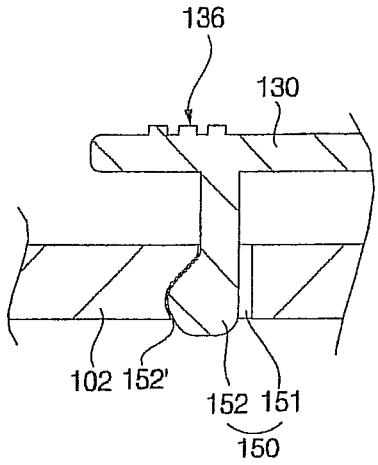
FIG. 9 is a sectional view taken along the line A-A of FIG. 8.

With reference to FIGS. 9 and 12, the locking means 150 includes a hook hole 151 formed in the door 102, and a hook 152 protruded from the cover 130 to be detachably inserted into the hook hole 151. The hook 152 is formed by a curved surface having a designated curvature in order to minimize friction between a friction surface 152' of the hook 152 and the hook hole 151 when the hook 152 is inserted into or released from the hook hole 151. Here, cut-off lines 154 are provided between the hook 152 and the rim 134 so that the hook 152 can be separated from the rim 134.

The ventilating structure of the washing machine of the present invention further comprises regular ventilating means for constantly ventilating the washing tub 100 even when the ventilating holes 110 are covered with the cover 130 during the semi-drying operation.

With reference to FIGS. 8, 12 and 17, the regular ventilating means includes a regular ventilating portion 160, which is a portion of the rim 134 of the cover 130, protruded from the rectangular panel 132 of the cover 130, having a length smaller than those of other portions of the rim 134, thereby ventilating the washing tub 100 through the rim 134 of the cover 130 even when the ventilating holes 110 are covered with the cover 130. Of course, the length of the regular ventilating portion 160 protruded from the cover 130 is smaller than a cleavage between the cover 130 and the door 102 when the ventilating holes 110 are covered with the cover 130.

The ventilating structure of the washing machine of the present invention further comprises cover noise prevention means for preventing noise generated due to the movement of the cover 130 in the opening and closing direction of the cover 130 when the ventilating holes 110 are covered with the cover 130.

Figure 10:
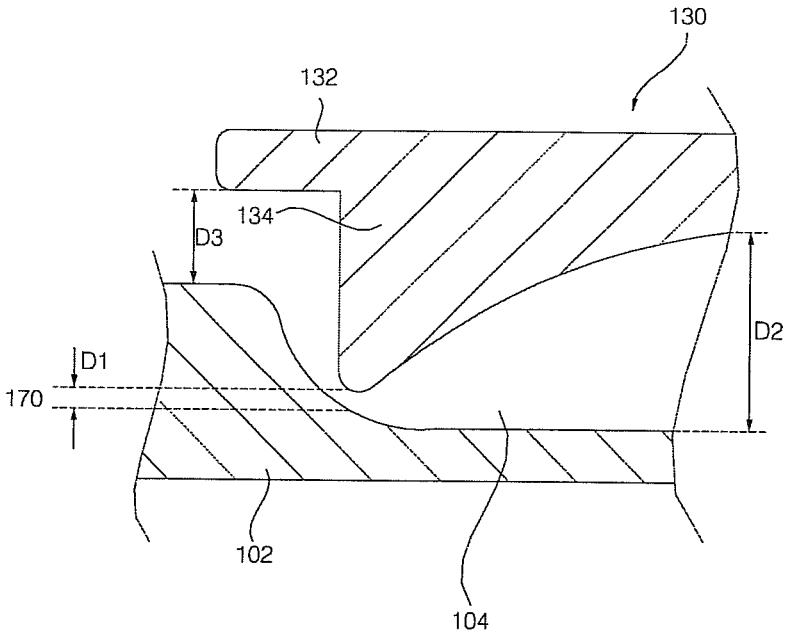
FIG. 10 is a sectional view taken along the line B-B of FIG. 8.

In the cover noise prevention means, particularly with reference to FIG. 10, the rectangular panel 132 of the cover 130 is supported by a backing-up member so that the rectangular panel 132 does not contact the door 102 when the ventilating holes 110 are covered with the cover 130, and the rim 134 is protruded from the rectangular panel 132 of the cover by a designated length so that a designated cleavage between the rim 134 and the door 102 is maintained. Accordingly, the cover 130 is supported only by the backing-up member, thus not generating any noise due to the movement of the cover 130.

Here, in case that the filter grip 126 is provided on the filter 120, the backing-up member has a designated height so that the filter grip 126 supports the rectangular panel 132 of the cover 132 when the ventilating holes 110 are covered with the cover 130.

Preferably, the minimum cleavage 170 between the rim 134 of the cover 130 and the door 102, when the ventilating holes 110 are covered with the cover 130, is 2 mm to 5 mm.

Figure 11:
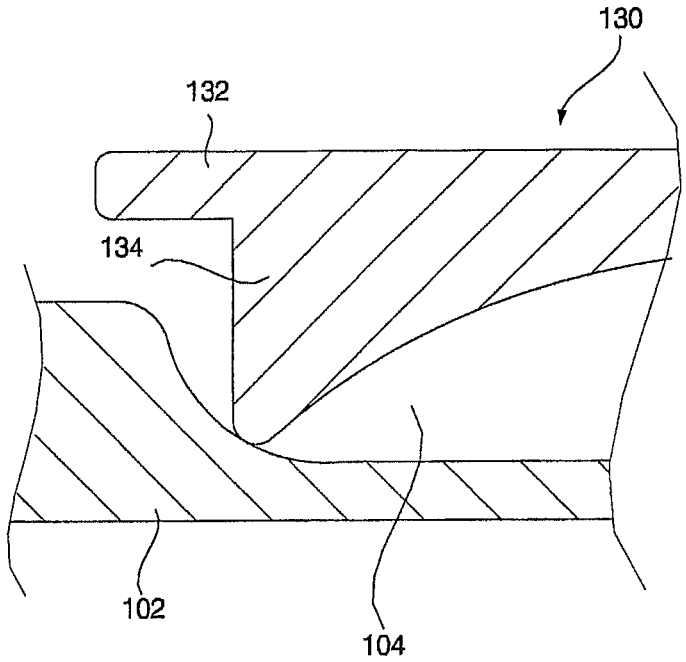
FIG. 11 is another sectional view taken along the line B-B of FIG. 8.

In another cover noise prevention means, particularly with reference to FIG. 11, the rim 134 of the cover 130 has a length slightly longer than the distance from the rectangular panel 132 of the cover 130 to the ventilating panel portion 104 when the ventilating holes 110 are covered with the cover 130. Then, when the covering state of the ventilating holes 110 with the cover 130 is maintained by the locking means 150, the door 102 compresses the rim 134 of the cover 130, thereby preventing the movement of the cover 130 and thus not generating any noise due to the movement of the cover 130.

The above-described ventilating structure of the washing machine of the present invention comprises the ventilating holes 110 formed through the door 102, thereby causing the cloth in the washing tub 100 to be sufficiently dehydrated by natural drying through ventilation as well as the dehydration through centrifugal force during the semi-drying operation.

Further, the ventilating structure comprises the filter 120 installed above the ventilating holes 110 and the cover 130 installed on the door 102 for covering the ventilating holes 110 when the ventilation of the washing tub 100 is not required, thereby preventing foreign substances from entering into the washing tub 100 through the ventilating holes 110.

Moreover, the ventilating structure comprises the rim 134 provided on the cover 130 including at least a portion having a length smaller than those of other portions of the rim 134, so that the washing tub 100 is ventilated through the ventilating holes 110 even when the ventilating holes 110 are covered with the cover 130, thereby improving semi-drying performance due to the ventilation although the user does not open the ventilating holes during the semi-drying operation. Although the cloth is left within the washing tub 100 for a long period of time after all operations of the washing machine are completed, the washing tub 100 is constantly ventilated and naturally dried by the ventilating structure, thus causing offensive odors to be removed from the cloth and preventing damage to the cloth.

INDUSTRIAL APPLICABILITY

As apparent from the above description, the present invention provides a semi-drying method of a washing machine, in which dehydration and disentanglement of cloth are repeated plural times, and a washing tub is rotated at a designated dehydration speed so as to minimize the jamming of the cloth into water pores of the washing tub during the dehydration and the duration of the dehydration is longer than that of the conventional dehydrating operation, thereby preventing the cloth from being damaged and wrinkled and improving the dehydration degree compared to the conventional dehydrating operation.

The semi-drying method of the present invention, which has the total duration of approximately several minutes, has a reduced power consumption rate compared to the drying operation of the conventional washing machine having a drying device, removes offensive odors from the cloth, and performs a process from the washing to the drying of the cloth in a time shorter than that of the conventional drying or dehydrating operation.

Further, the present invention provides a control apparatus for controlling a semi-drying method of a washing machine, which comprises time setting means installed on an operating unit for setting a duration of a semi-drying operation therethrough and displaying the obtained results thereon, thereby allowing a user to select the duration of the semi-drying operation according to his/her preference, and directly checking results obtained by the user's selection. The control apparatus of the present invention comprises a semi-dry state display installed on the operating unit for displaying the remaining time of the duration of the semi-drying operation, thereby allowing the user to see the state of the semi-drying operation.

Moreover, the present invention provides a ventilating structure of a washing machine for performing a semi-drying operation, in which ventilating holes are formed through a door, thereby improving the dehydration degree of cloth during the semi-drying operation.

The ventilating structure of the present invention comprises a filter installed above the ventilating holes and a cover installed on the door for closing the ventilating holes when the ventilation is not required, thereby preventing foreign substances from entering into the washing tub through the ventilating holes.

The ventilating structure of the present invention comprises regular ventilating means for ventilating the washing tub through the ventilating holes even when the ventilating holes are covered with the cover, thereby allowing the user to constantly ventilate the washing tub.

Although the cloth is left within the washing tub for a long period of time after all operations of the washing machine are completed, the ventilating structure of the present invention constantly ventilates the washing tub, thus removing offensive odors from the cloth and preventing damage to the cloth.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A ventilating structure of a washing machine for performing a semi-drying operation, comprising:

a door having a ventilating panel portion with an indented groove, the ventilating panel portion including a plurality of ventilating holes for ventilating a washing tub during the semi-drying operation, in which dehydration of clothes in the washing tub is performed;

a filter provided in the indented groove of the ventilating panel portion such that the filter is on the plurality of ventilating holes, and a surface of the filter is parallel with a surface of the ventilating panel portion; and a cover coupled to the door for opening or closing the ventilating holes, wherein the cover has a side spaced from the door by a predetermined distance when the ventilating holes are covered by the cover, wherein a bottom surface of a front portion of the cover does not contact the door based on the predetermined distance of the spacing when the ventilating holes are covered by the cover and wherein the washing tub is allowed to be ventilated through the ventilating holes even when the ventilating holes are covered by the cover.

2. The ventilating structure as set forth in claim 1, wherein a diameter of one or more of the ventilating holes gradually narrows from an outer surface of the washing tub to an inner surface of the washing tub.

3. The ventilating structure as set forth in claim 1, wherein the filter for filtering air passing through the ventilating holes.

4. The ventilating structure as set forth in claim 1, wherein the filter includes a filter grip for facilitating placement of the filter, and wherein the filter grip has a predetermined height for supporting the cover when the ventilating holes are covered with the cover.

5. The ventilating structure as set forth in claim 1, further comprising a hinge to rotate the cover in inward and outward directions relative to the washing machine, wherein the hinge is between the cover and the door.

6. The ventilating structure as set forth in claim 5, wherein the hinge includes:

first bosses, each of which is adjacent to the door and a pin;

second bosses, each of which is adjacent to the cover and provided with a groove having a partially cut-off portion for rotatably receiving or releasing the pin; and supporting members, each of which is provided on a corresponding one of the second bosses, and locked with a corresponding one of the first bosses when the cover is opened from the door by a predetermined angle or more to separate the pin from the groove.

7. The ventilating structure as set forth in claim 1, further comprising:

a hook at one of the door or the cover, and a hook hole at the other of the door or the cover, wherein the hook is to be coupled to the hook hole to lock the cover into the door when the ventilating holes are covered by the cover.

8. The ventilating structure as set forth in claim 1, further comprising a rim adjacent the front portion of the cover and an inner surface of the cover, wherein the rim extends in a direction that crosses a plane of the cover.

9. The ventilating structure as set forth in claim 8, wherein a portion of the rim prevents the cover from contacting the door when the ventilating holes are covered by the cover.

10. The ventilating structure as set forth in claim 9, wherein the frame is between the ventilating holes and the cover, wherein the rim extends from the frame to prevent a portion of the rim from contacting the door when the cover is over the ventilating holes.

11. The ventilating structure as set forth in claim 9, wherein the cover is only supported by the rim when the cover is over the ventilating holes.

12. The ventilating structure as set forth in claim 8, wherein:

a lock means to maintain the covering of the ventilating holes with the cover.

13. The ventilating structure as set forth in claim 12, wherein the door compresses the rim when the ventilating holes are covered with the cover.

14. The ventilating structure as set forth in claim 8, wherein a portion of the rim contacts the door to establish the spacing at the predetermined distance between the cover and door.

15. The ventilating structure as set forth in claim 8, wherein a portion of the rim does not contact the door.

16. The ventilating structure as set forth in claim 1, wherein the door includes:

a first panel having a window, and a second panel pivotally coupled to the first panel, wherein the second panel overlaps the first panel to allow access into the washing tub and wherein a cover panel is coupled to the second panel of the door.

17. The ventilating structure as set forth in claim 1, further comprising:

a water hole adjacent at least one of the ventilating holes, wherein the water hole is located below a surface of the door and wherein the water hole is in fluid communication with an interior of a washing tub.

18. The ventilating structure as set forth in claim 1, wherein the ventilating panel portion includes a water hole on a wall of the indented groove.

19. A ventilating structure of a washing machine for performing a semi-drying operation, comprising:

a door having a ventilating panel portion with an indented groove, the ventilating panel portion including a plurality of ventilating holes;

a filter provided in the indented groove of the ventilating panel portion such that the filter is on the plurality of ventilating holes, and a surface of the filter is parallel with a surface of the ventilating panel portion;

a cover at the door for opening or closing the ventilating holes, wherein the cover comprises a cover panel having a side portion spaced from the door by a predetermined distance when the ventilating holes are covered by the cover to allow a washing tub to be ventilated through the ventilating holes even when the ventilating holes are covered by the cover, wherein the side portion of the cover does not contact the door based on the predetermined distance of the spacing when the ventilating holes are covered by the cover.

20. The ventilating structure as set forth in claim 19, further comprising:

a rim between the cover and door and which extends in a direction that crosses a plane of the cover.

21. The ventilating structure as set forth in claim 20, wherein the rim is at the cover.

22. The ventilating structure as set forth in claim 19, wherein the ventilating panel portion includes a water hole on a wall of the indented groove.

* * * * *